US008259903B1

(12) United States Patent
Toh

(10) Patent No.: US 8,259,903 B1
(45) Date of Patent: Sep. 4, 2012

(54) DYNAMICALLY COMPUTED X-RAY INPUT POWER FOR CONSISTENT IMAGE QUALITY

(75) Inventor: Chin H. Toh, Orange, CA (US)

(73) Assignee: The Boeing Company, Chicago, IL (US)

( * ) Notice: Subject to any disclaimer, the term of this patent is extended or adjusted under 35 U.S.C. 154(b) by 169 days.

(21) Appl. No.: 12/896,655

(22) Filed: Oct. 1, 2010

(51) Int. Cl.
*H05G 1/08* (2006.01)

(52) U.S. Cl. ..... 378/91

(58) Field of Classification Search ..... 378/101, 378/91, 108, 110–112
See application file for complete search history.

(56) References Cited

U.S. PATENT DOCUMENTS 5,822,393 A * 10/1998 Popescu ..... 378/108
2005/0047546 A1* 3/2005 Fox et al. ..... 378/91

OTHER PUBLICATIONS

J. H. Hubbell and S. M. Seltzer, "Tables of X-Ray Mass Attenuation Coefficients and Mass Energy-Absorption Coefficients", NIST Standard Reference Database 126, Jul. 2004, Section 2: X-Ray Mass Attenuation Coefficients available at http://physics.nist.gov/PhysRefData/XrayMassCoef/chap2.html.

* cited by examiner

*Primary Examiner* — Irakli Kiknadze
(74) *Attorney, Agent, or Firm* — Kathryn A. Soucy

(57) ABSTRACT

Presented is a system and method for dynamically adjusting X-ray power levels to achieve consistent image quality. The method comprises estimating power and photon density based on current process parameters, comparing those estimates with reference values associated with desirable image quality, adjusting the X-ray power level in response to the operation of comparing, and then performing the operations of estimating, comparing, and adjusting so that the estimates approach the reference values. In embodiments, the estimating, comparing, and adjusting operations are performed dynamically as process parameters, such as X-ray spot size and distance to the target, dynamically change. The system comprises a database for storing the reference values and a processor for estimating the photon and power density based on current process parameters, comparing the reference values with the estimates, and outputting a signal to adjust one of the current process parameters such as X-ray power level.

20 Claims, 6 Drawing Sheets

FIG. 3

300

306

302 310 308

| Standoff, mm | Cover Thick, mm | Cover/ Object Distance, mm | Input power, Watts (Joules/ sec) | Exit power after cover, Watts | Photons number/sec | FOC Df, mm | Aperture Da, mm | Pixel, mm | Beam Tube L, mm | Scan Distance D, mm | Cone A, mm | Spot Size, Ds, mm | Scan Speed, cm/s | Spots per sec | Power density J/mm$^2$ | Photon density no./mm$^2$ | Exit power adjustment needed, J/sec | Photon density change, % | Remark |
|---|---|---|---|---|---|---|---|---|---|---|---|---|---|---|---|---|---|---|---|
| 25.40 | 6.35 | 101.60 | 640.00 | 421.31 | 6.36E+17 | 3.00 | 1.00 | 1.00 | 75.00 | 133.35 | 18.75 | 8.11 | 1.00 | 1.23 | 6.62 | 9.99E+15 | 0.00 | 0.00E+00 | Reference |
| 25.40 | 6.35 | 101.60 | 640.00 | 421.31 | 6.36E+17 | 3.00 | 1.00 | 1.00 | 75.00 | 133.35 | 18.75 | 8.11 | 2.00 | 2.47 | 3.31 | 4.99E+15 | 421.31 | -5.00E+01 | |
| 25.40 | 6.35 | 101.60 | 640.00 | 421.31 | 6.36E+17 | 3.00 | 1.00 | 1.00 | 75.00 | 133.35 | 18.75 | 8.11 | 3.00 | 3.70 | 2.21 | 3.33E+15 | 842.62 | -6.67E+01 | |
| 25.40 | 6.35 | 101.60 | 640.00 | 421.31 | 6.36E+17 | 3.00 | 1.00 | 1.00 | 75.00 | 133.35 | 18.75 | 8.11 | 4.00 | 4.93 | 1.65 | 2.50E+15 | 1263.93 | -7.50E+01 | |
| 25.40 | 6.35 | 101.60 | 640.00 | 421.31 | 6.36E+17 | 3.00 | 1.00 | 1.00 | 75.00 | 133.35 | 18.75 | 8.11 | 5.00 | 6.16 | 1.32 | 2.00E+15 | 1685.24 | -8.00E+01 | |
| | | | | | | | | | | | | | | | | | | | |
| 25.40 | 6.35 | 101.60 | 640.00 | 421.31 | 6.36E+17 | 3.00 | 1.00 | 1.00 | 75.00 | 133.35 | 18.75 | 8.11 | 1.00 | 1.23 | 6.62 | 9.99E+15 | 0.00 | 0.00 | Reference |
| 25.40 | 6.35 | 101.60 | 1280.00 | 842.62 | 1.27E+18 | 3.00 | 1.00 | 1.00 | 75.00 | 133.35 | 18.75 | 8.11 | 2.00 | 2.47 | 6.62 | 9.99E+15 | 0.00 | 0.00 | |
| 25.40 | 6.35 | 101.60 | 1920.00 | 1263.93 | 1.91E+18 | 3.00 | 1.00 | 1.00 | 75.00 | 133.35 | 18.75 | 8.11 | 3.00 | 3.70 | 6.62 | 9.99E+15 | 0.00 | 0.00 | |
| 25.40 | 6.35 | 101.60 | 2560.00 | 1685.24 | 2.54E+18 | 3.00 | 1.00 | 1.00 | 75.00 | 133.35 | 18.75 | 8.11 | 4.00 | 4.93 | 6.62 | 9.99E+15 | 0.00 | 0.00 | |
| 25.40 | 6.35 | 101.60 | 3200.00 | 2106.55 | 3.18E+18 | 3.00 | 1.00 | 1.00 | 75.00 | 133.35 | 18.75 | 8.11 | 5.00 | 6.16 | 6.62 | 9.99E+15 | 0.00 | 0.00 | |
| | | | | | | | | | | | | | | | | | | | |
| 25.40 | 6.35 | 101.60 | 640.00 | 421.31 | 6.36E+17 | 3.00 | 1.00 | 1.00 | 75.00 | 133.35 | 18.75 | 8.11 | 1.00 | 1.23 | 6.62 | 9.99E+15 | 0.00 | 0.00E+00 | Reference |
| 25.40 | 6.35 | 203.20 | 640.00 | 421.31 | 6.36E+17 | 3.00 | 1.00 | 1.00 | 75.00 | 234.95 | 18.75 | 13.53 | 1.00 | 0.74 | 3.97 | 5.99E+15 | 281.43 | -4.00E+01 | |
| 25.40 | 6.35 | 304.80 | 640.00 | 421.31 | 6.36E+17 | 3.00 | 1.00 | 1.00 | 75.00 | 336.55 | 18.75 | 18.95 | 1.00 | 0.53 | 2.83 | 4.28E+15 | 562.86 | -5.72E+01 | |
| 25.40 | 6.35 | 406.40 | 640.00 | 421.31 | 6.36E+17 | 3.00 | 1.00 | 1.00 | 75.00 | 438.15 | 18.75 | 24.37 | 1.00 | 0.41 | 2.20 | 3.32E+15 | 844.28 | -6.67E+01 | |
| 25.40 | 6.35 | 508.00 | 640.00 | 421.31 | 6.36E+17 | 3.00 | 1.00 | 1.00 | 75.00 | 539.75 | 18.75 | 29.79 | 1.00 | 0.34 | 1.80 | 2.72E+15 | 1125.71 | -7.28E+01 | |
| | | | | | | | | | | | | | | | | | | | |
| 25.40 | 6.35 | 101.60 | 640.00 | 421.31 | 6.36E+17 | 3.00 | 1.00 | 1.00 | 75.00 | 133.35 | 18.75 | 8.11 | 1.00 | 1.23 | 6.62 | 9.99E+15 | 0.00 | 0.00 | Reference |
| 25.40 | 6.35 | 203.20 | 1067.51 | 702.74 | 1.06E+18 | 3.00 | 1.00 | 1.00 | 75.00 | 234.95 | 18.75 | 13.53 | 1.00 | 0.74 | 6.62 | 9.99E+15 | 0.00 | 0.00 | |
| 25.40 | 6.35 | 304.80 | 1495.02 | 984.17 | 1.49E+18 | 3.00 | 1.00 | 1.00 | 75.00 | 336.55 | 18.75 | 18.95 | 1.00 | 0.53 | 6.62 | 9.99E+15 | 0.00 | 0.00 | |
| 25.40 | 6.35 | 406.40 | 1922.52 | 1265.59 | 1.91E+18 | 3.00 | 1.00 | 1.00 | 75.00 | 438.15 | 18.75 | 24.37 | 1.00 | 0.41 | 6.62 | 9.99E+15 | 0.00 | 0.00 | |
| 25.40 | 6.35 | 508.00 | 2350.03 | 1547.02 | 2.34E+18 | 3.00 | 1.00 | 1.00 | 75.00 | 539.75 | 18.75 | 29.79 | 1.00 | 0.34 | 6.62 | 9.99E+15 | 0.00 | 0.00 | |

Input Data Field

Adjusted Input Power — 304

FIG. 4

400

306

| Standoff, mm | Cover Thick, mm | Cover/ Object Distance, mm (408) | Input power, Watts (Joules/ sec) | Exit power after cover, Watts | Photons number/sec | FOC Df, mm (402) | Aperture Da, mm (402) | Pixel, mm (402) | Beam Tube L, mm (402) | Scan Distance D, mm (402) | Cone A, mm (402) | Spot Size, Ds, mm (402) | Scan Speed, cm/s (402) | Spots per sec | Power density J/mm2 (310) | Photon density no./mm2 (308) | Exit power adjustment needed, J/sec | Photon density change, % | Remark |
|---|---|---|---|---|---|---|---|---|---|---|---|---|---|---|---|---|---|---|---|
| 25.40 | 6.35 | 101.60 | 640.00 | 421.31 | 6.36E+17 | 3.00 | 1.00 | 1.00 | 75.00 | 133.35 | 18.75 | 8.11 | 1.00 | 1.23 | 6.62 | 9.99E+15 | 0.00 | 0.00E+00 | Reference |
| 20.00 | 6.35 | 101.60 | 640.00 | 421.31 | 6.36E+17 | 3.00 | 1.00 | 1.00 | 75.00 | 127.95 | 18.75 | 7.82 | 1.00 | 1.28 | 6.86 | 1.04E+16 | -14.96 | 3.68E+00 | |
| 25.40 | 6.35 | 101.60 | 640.00 | 421.31 | 6.36E+17 | 3.00 | 1.00 | 1.00 | 75.00 | 133.35 | 18.75 | 8.11 | 3.00 | 3.70 | 2.21 | 3.33E+15 | 842.62 | -6.67E+01 | |
| 25.40 | 6.35 | 101.60 | 640.00 | 421.31 | 6.36E+17 | 3.00 | 1.00 | 1.00 | 75.00 | 133.35 | 18.75 | 8.11 | 4.00 | 4.93 | 1.65 | 2.50E+15 | 1263.93 | -7.50E+01 | |
| 30.00 | 10.00 | 101.60 | 640.00 | 331.31 | 5.00E+17 | 2.00 | 2.00 | 1.00 | 75.00 | 141.60 | 37.50 | 9.55 | 1.00 | 1.05 | 4.42 | 6.67E+15 | 164.79 | -3.32E+01 | |
| | | | | | | | | | | | | | | | | | | | |
| 25.40 | 6.35 | 101.60 | 640.00 | 421.31 | 6.36E+17 | 3.00 | 1.00 | 1.00 | 75.00 | 133.35 | 18.75 | 8.11 | 1.00 | 1.23 | 6.62 | 9.99E+15 | 0.00 | 0.00 | Reference |
| 20.00 | 6.35 | 101.60 | 617.28 | 406.35 | 6.13E+17 | 3.00 | 1.00 | 1.00 | 75.00 | 127.95 | 18.75 | 7.82 | 1.00 | 1.28 | 6.62 | 9.99E+15 | 0.00 | 0.00 | |
| 25.40 | 6.35 | 101.60 | 1920.00 | 1263.93 | 1.91E+18 | 3.00 | 1.00 | 1.00 | 75.00 | 133.35 | 18.75 | 8.11 | 3.00 | 3.70 | 6.62 | 9.99E+15 | 0.00 | 0.00 | |
| 25.40 | 6.35 | 101.60 | 2560.00 | 1685.24 | 2.54E+18 | 3.00 | 1.00 | 1.00 | 75.00 | 133.35 | 18.75 | 8.11 | 4.00 | 4.93 | 6.62 | 9.99E+15 | 0.00 | 0.00 | |
| 30.00 | 10.00 | 101.60 | 958.34 | 496.10 | 7.49E+17 | 2.00 | 2.00 | 1.00 | 75.00 | 141.60 | 37.50 | 9.55 | 1.00 | 1.05 | 6.62 | 9.99E+15 | 0.00 | 0.00 | |
| | | | | | | | | | | | | | | | | | | | |
| 25.40 | 6.35 | 101.60 | 640.00 | 421.31 | 6.36E+17 | 3.00 | 1.00 | 1.00 | 75.00 | 133.35 | 18.75 | 8.11 | 1.00 | 1.23 | 6.62 | 9.99E+15 | 0.00 | 0.00E+00 | Reference |
| 25.40 | 6.35 | 101.60 | 640.00 | 421.31 | 6.36E+17 | 3.00 | 1.00 | 1.00 | 50.00 | 133.35 | 12.50 | 11.67 | 1.00 | 0.86 | 4.60 | 6.94E+15 | 184.69 | -3.05E+01 | |
| 20.00 | 5.00 | 101.60 | 640.00 | 460.47 | 6.95E+17 | 3.00 | 1.00 | 1.00 | 75.00 | 126.60 | 18.75 | 7.75 | 1.00 | 1.29 | 7.57 | 1.14E+16 | -57.86 | 1.44E+01 | |
| 25.40 | 6.35 | 406.40 | 640.00 | 421.31 | 6.36E+17 | 3.00 | 1.00 | 1.00 | 75.00 | 438.15 | 18.75 | 24.37 | 3.00 | 1.23 | 0.73 | 1.11E+15 | 3375.47 | -8.89E+01 | |
| 25.40 | 6.35 | 508.00 | 640.00 | 421.31 | 6.36E+17 | 3.00 | 1.00 | 1.00 | 75.00 | 539.75 | 18.75 | 29.79 | 1.00 | 0.34 | 1.80 | 2.72E+15 | 1125.71 | -7.28E+01 | |
| | | | | | | | | | | | | | | | | | | | |
| 25.40 | 6.35 | 101.60 | 640.00 | 421.31 | 6.36E+17 | 3.00 | 1.00 | 1.00 | 75.00 | 133.35 | 18.75 | 8.11 | 1.00 | 1.23 | 6.62 | 9.99E+15 | 0.00 | 0.00 | Reference |
| 25.40 | 6.35 | 101.60 | 920.55 | 606.00 | 9.15E+17 | 3.00 | 1.00 | 1.00 | 50.00 | 133.35 | 12.50 | 11.67 | 1.00 | 0.86 | 6.62 | 9.99E+15 | 0.00 | 0.00 | |
| 20.00 | 5.00 | 101.60 | 559.58 | 402.61 | 6.08E+17 | 3.00 | 1.00 | 1.00 | 75.00 | 126.60 | 18.75 | 7.75 | 1.00 | 1.29 | 6.62 | 9.99E+15 | 0.00 | 0.00 | |
| 25.40 | 6.35 | 406.40 | 5767.57 | 3796.78 | 5.73E+18 | 3.00 | 1.00 | 1.00 | 75.00 | 438.15 | 18.75 | 24.37 | 3.00 | 1.23 | 6.62 | 9.99E+15 | 0.00 | 0.00 | |
| 25.40 | 6.35 | 508.00 | 2350.03 | 1547.02 | 2.34E+18 | 3.00 | 1.00 | 1.00 | 75.00 | 539.75 | 18.75 | 29.79 | 1.00 | 0.34 | 6.62 | 9.99E+15 | 0.00 | 0.00 | |

404

406

Input Data Field

Adjusted Input Power (304)

402 402

DYNAMICALLY COMPUTED X-RAY INPUT POWER FOR CONSISTENT IMAGE QUALITY

FIELD

Embodiments of the subject matter described herein relate generally to a system and method for dynamically adjusting X-ray power for consistent image quality.

BACKGROUND

It is well recognized that the quality of X-ray images depends largely on the level of power from the X-ray generator. A stronger power produces a sharper and clearer image. However, too much power can over saturate a sensor, decreasing the contrast between different portions of the subject matter being imaged and potentially harming the subject matter itself. Also, higher power can also increase the cost of the X-ray system necessary to produce the X-rays. Variations in other process parameters such as scan distance to the subject matter, scan speed, X-ray beam tube dimension, and presence of cover materials between the subject matter and imaging sensor result in divergence from a desirable photon density, or power density, necessary to achieve a consistent image quality.

Variations in the process parameters that change over a portion of a scan or that change dynamically during a scan can be difficult to compensate for. When variations in the process parameters change, parts of scan may have sufficient quality, other parts have an inferior quality from insufficient power, and some parts may be over saturated from too much power. This may necessitate performing multiple scans at different power levels to image all portions of the subject matter sufficiently. However, multiple scans at different power levels subject the subject matter to multiple exposures of X-ray energy, which can damage or harm the subject matter. Further, scans where the power has been increased run the risk subjecting some parts of the subject matter to a much higher than desirable X-ray energy. For traditional transmission X-ray systems, where the subject matter is already being irradiated with X-rays capable of penetrating the subject matter, this may merely result in an increase of X-ray energy coupling to the material. However, for backscattering X-ray systems, where a portion of the X-rays penetrate the subject matter depending on its material and thickness, increasing the power may result in X-rays penetrating to an unanticipated depth, or unwanted depth, which can harm structures within the subject matter that were not designed to handle, or are not capable of handling, high X-ray energy.

Therefore it would be desirable to control X-ray energy from an X-ray system so that the subject matter being imaged is exposed to a level of X-ray energy sufficient to produce an image of acceptable quality, without overexposing the image or potentially damaging underlying structures in the subject matter. When scanning, it would be desirable to compensate for variations in process parameters, such as distance to the subject matter and absorption due to intervening cover materials, so that the X-rays impinging on the subject matter produce an acceptable image quality.

SUMMARY

Presented is a system and method for dynamically adjusting X-ray power to produce consistent image quality. In an embodiment, the photon and power densities of the X-ray beam at the subject matter are estimated based on current process parameters. Those estimates are compared with reference values associated with desirable image quality. The X-ray power level is adjusted in response to the comparison between the estimates and reference values. The operations of estimating, comparing, and adjusting repeated if necessary until the estimates approach the reference values. In embodiments, the estimating, comparing, and adjusting operations are performed dynamically as process parameters, such as X-ray spot size and distance to the target, dynamically change. In embodiments, the X-ray power levels dynamically change during a scan of different portions of a target subject. In embodiments, a database stores reference values and a processor estimates photon and power densities based on current process parameters. The processor compares the stored reference values with the photon and power density estimates, and outputs a signal to adjust one of the current process parameters, for example the X-ray power level.

The system and method offer improvements in the consistency of the image quality of X-ray images a target subject matter. The system and method offer potential scheduling savings because scans can be performed just once to achieve a consistent image quality across the entire target subject, instead of potentially requiring multiple passes at different power levels to obtain a desired image quality for different parts of a target subject.

The features, functions, and advantages discussed can be achieved independently in various embodiments of the present invention or may be combined in yet other embodiments further details of which can be seen with reference to the following description and drawings.

BRIEF DESCRIPTION OF THE DRAWINGS

The accompanying figures depict various embodiments of the system and method for dynamically adjusting X-ray power to produce consistent image quality. A brief description of each figure is provided below. Elements with the same reference number in each figure indicated identical or functionally similar elements. Additionally, the left-most digit(s) of a reference number indicate the drawing in which the reference number first appears.

FIG. 3 is a first table showing the effect of varying scanning speeds on other process parameters in one embodiment of the system and method for dynamically adjusting X-ray power to produce consistent image quality;

FIG. 4 is a second table showing the effect of varying random process parameters on other process parameters in one embodiment of the system and method for dynamically adjusting X-ray power to produce consistent image quality;

DETAILED DESCRIPTION

The following detailed description is merely illustrative in nature and is not intended to limit the embodiments of the invention or the application and uses of such embodiments. Furthermore, there is no intention to be bound by any expressed or implied theory presented in the preceding technical field, background, brief summary or the following detailed description.

Stronger power X-rays generally produce sharper and clearer images, but with tradeoffs. High power X-ray systems are generally more expensive than lower power X-ray systems. Further, if the X-ray power is increased too much, it can oversaturate a sensor, decreasing the contrast between different portions of the subject matter being imaged, or otherwise degrading an image, for example by energy from one part of the sensor bleeding into an adjacent part of the sensor. Further, high-energy X-rays have a greater probability of damaging the subject matter. For any particular application, there is a desirable range of X-ray energy for producing sufficient image quality of the subject matter in a cost effective manner.

However, determining the amount of X-ray energy incident upon the subject matter at any portion of the scan depends upon a number of process parameters, including the scan distance to the subject matter to determine the area of the X-ray beam incident upon the subject matter, the scan speed of the subject matter relative to the X-ray beam incident upon the subject matter, the X-ray beam tube dimensions, and the presence of any covering or cover materials between the subject matter and sensor. In some applications, one or more of the process parameters change dynamically during a scan. Further, the subject matter may not be uniform in construction or can have cover materials that vary in density, requiring different powers for different portions of the scan. These process parameters and variations in the cover and subject matter results in the power levels incident upon the subject matter diverging from a desirable range of photon densities, or power densities, that are necessary to achieve a consistent image quality.

Therefore it would be desirable to have a system and method for dynamically adjusting the power of an X-ray source so to achieve a desirable range of power across the subject matter. The present disclosure contemplates a system and method for dynamically adapting the X-ray power of an X-ray system during a scan of subject matter to achieve a consistent image quality of the subject matter.

Figure 1:
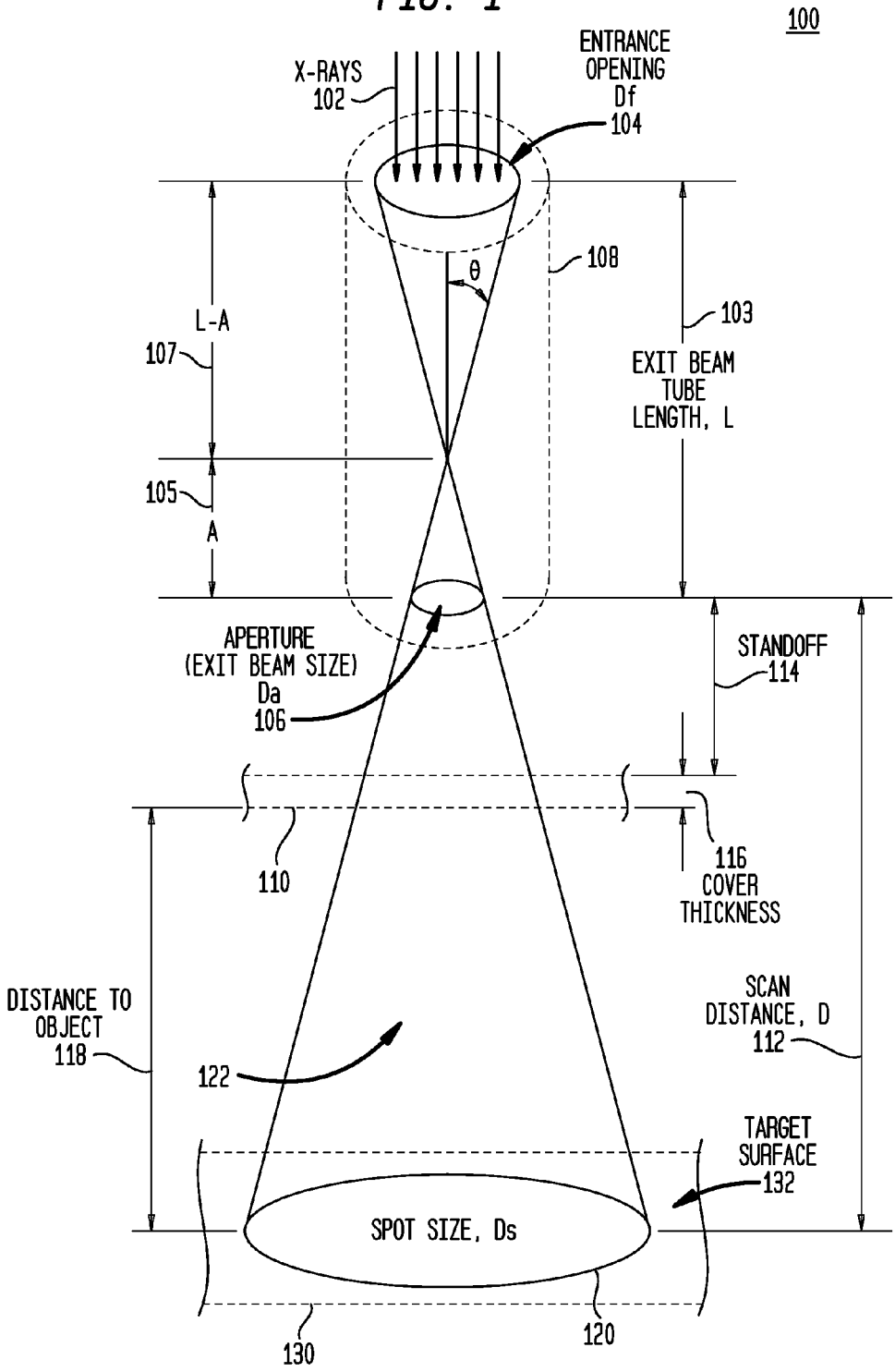
FIG. 1 is a schematic of the scanning process.
Figure 6:
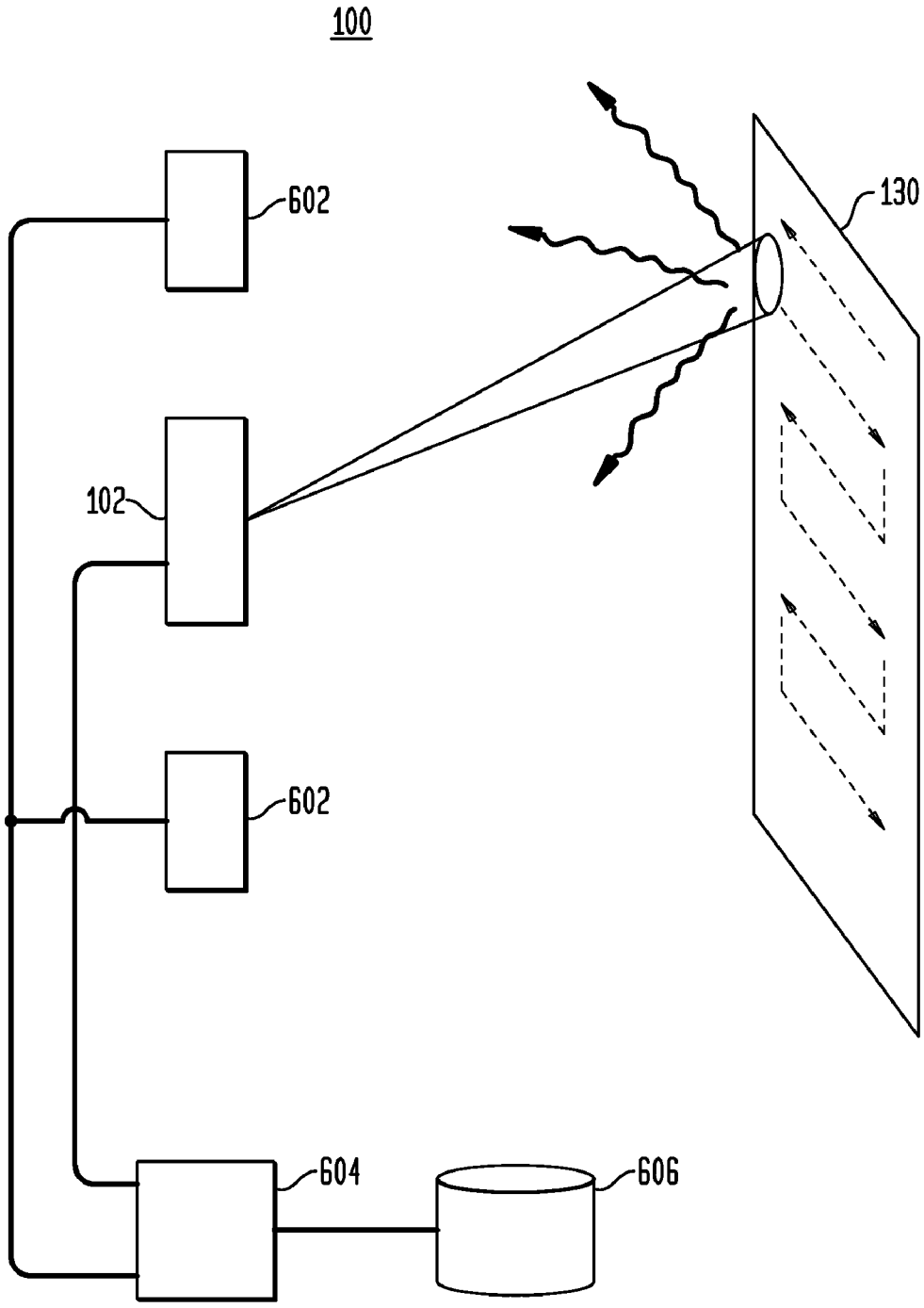
FIG. 6 is a diagram of an exemplary scanning system in one embodiment of the system and method for dynamically adjusting X-ray power to produce consistent image quality.

Referring now to FIGS. 1 and 6, schematic models of the X-ray scanning process parameters for an exemplary scanning X-ray system 100 are presented. The scanning X-ray system 100 comprises a source of X-rays 102 that produces X-ray beams that contain X-ray photons 122 that pass through an entrance opening 104 adjacent to the source of X-rays 102. The X-ray photons 122 travel from the entrance opening 104 the distance of the X-ray beam tube 108 to the aperture 106. The passing of the X-ray photons 122 through the entrance opening 104, along the X-ray beam tube 108, and through an aperture 106, serves to focus the X-ray photons 122 onto a spot 120 that impinges on the front surface 132 of the target subject matter 130. The diameter, Ds, of the spot 120 can be computed as follows:

$$\tan\theta=(Df/2)/(L-A) \quad \text{(Equation 1)}$$

$$\tan\theta=(Da/2)/A \quad \text{(Equation 2)}$$

Equation 1 can be equated with Equation 2 because the angle of convergence, θ, is the same for the incoming X-rays 102 and outgoing X-rays 102, which produces the equation:

$$(Df/2)/(L-A)=(Da/2)/A \quad \text{(Equation 3)}$$

that reduces as follows to produce a value for A, 105, of:

$$A=L(Da/2)/(Df/2+Da/2) \quad \text{(Equation 4)}$$

The ratio of the diameter, Da, of the aperture 106 to the diameter, Ds, of the spot 120 is governed by the following equation:

$$(Da/2)/(Ds/2)=A/(D+A) \quad \text{(Equation 5)}$$

that reduces as follows to produce a value for the diameter, Ds, of the spot 120 of:

$$Ds=2(Da/2)(D+A)/A \quad \text{(Equation 6)}$$

where θ is the angle of convergence, where Ds is the diameter of the spot 120, where Da is the diameter of the aperture 106 of the X-ray beam tube 108, where D is the scanning distance 112, and where A, 105, is the distance from the aperture 106 to the point in the X-ray beam tube 108 where the X-rays 102 converge. In an X-ray beam tube 108 of length L, 103, the X-rays 102 converge at a position that is distance L-A, 107, from the entrance opening 104 of the X-ray beam tube 108, and distance A, 105 from the aperture 106.

For a scanning X-ray system 100 that uses soft X-rays, one or more detectors 602 receives backscatter radiation, or X-ray photons 122 backscattered from the target subject matter 130, to create an image of the target subject matter 130. In embodiments, a detector 602 is a scintillation pad such as PVT (Polyvinyl Toluene) with a photomultiplier tube and photon detectors such as photodiodes, CCDs, or other photosensors, or can be solid state detectors as would be understood in the art. In an embodiment, a processor 604, or a computer imaging system, produces an image of the target subject matter 130, or set of data representing the image of the target subject matter 130.

The aperture 106 of the X-ray beam tube 108 is at a standoff distance 114 from a cover 110 that protects the components of the scanning X-ray system 100 from dust and other contaminant. Because of an intervening cover 110, the X-ray photons 122 on their way to the target subject matter 130 will penetrate the cover 110, lose some energy, and reach the target subject matter with a reduced intensity, or power. The cover 110 has a cover thickness 116. A distance to the target 118 is defined as the distance from the cover 110 to the front surface 132 of the target subject matter 130 to be scanned. However, the scanning distance 112 is the distance from the opening of the aperture 106 to the target subject matter 130. The scanning distance 112 is the sum of the standoff distance 114, the cover thickness 116, and the distance to the target 118.

The size of the spot 120 is dependent upon the geometry of the scanning X-ray system 100. The energy reaching the target subject matter 130 is dependent on the complex interaction between the size of the spot 120 and the dynamics of the scanning process. The scanning speed plays an important role in the calculations of photon density and power density.

For electromagnetic waves, the theoretical photon energy is expressed as Ei=h f where h is Planck's constant, 6.625E-34 Joules-sec, and f is the X-ray frequency, 1.00E+18 hertz (cycles per second) for the X-ray photons 122. The subscript i indicates the energy for one photon. In embodiments, the X-ray photons 122 are high energy photons from hard X-rays. In embodiments, the X-ray photons 122 are high energy photons from soft X-rays, such as backscatter X-rays, having energy sufficient to penetrate the cover 110 but not necessarily the target subject matter 130. The total energy for Np number of photons is E=ΣEi=hfNp. If the X-ray input power is expressed in Watts (Joules/sec), then Np becomes the number of generated photons per second.

The X-ray photons 122 pass through the cover 110 on the way to the target subject matter 130. Generally, the X-ray photons 122 will have an incident intensity Io, but after penetrating a layer of material with mass thickness x and density ρ, the X-ray photons 122 will emerge with the intensity I given by the exponential attenuation law:

$$I=Io\exp[-(\mu/\Sigma)x]. \quad \text{(Equation 7)}$$

The mass thickness x is defined as the mass per unit area, and is obtained by multiplying the material thickness t by its density ρ, that is, x=ρt.

Assuming that the power of incident X-ray photons 122, E, also follows this attenuation law and after substitution of x=ρt, Equation 1 becomes:

$$E=Eo\exp[-\mu t] \quad \text{(Equation 8)}$$

where Eo is the initial power input and μ is a material characteristic. It follows that ln(E/Eo)=μt. Consider that the X-ray photons 122 passing through a material with two different thicknesses t1 and t2 separately, the attenuated power equations are ln(E1/Eo)=μt1 and ln(E2/Eo)=t2, respectively. By substitution and simplification, the combined power equation after attenuation is:

$$E2=Eo[E1/Eo]\hat{}(t2/t1). \quad \text{(Equation 9)}$$

For computational purpose, further assuming that when the X-rays passed through the thickness t1=0.063 in, its power had been reduced by 10%. That is, E1=0.9 Eo. With this assumption, the generic power attenuation equation becomes $$Ep=Eo[0.9]\hat{}(tp/0.063) \quad \text{(Equation 10)}$$

Equation 4 is a generic power attenuation equation that will be used in this disclosure and computation examples in conveying the idea and concept of the proposed method. A more accurate number, other than the assumed 10%, can be obtained by performing the actual X-ray tests using the real materials. Note that Equation 4 uses inches for the thickness. Other consistent units, such as millimeters (mm), would also be used for the material thickness. The conversion is 1 inch=25.4 mm.

Substituting Equation 4 for the attenuated power with Ep=hfNp from generated photon energy, the generated photons per second after penetrating a cover 110 material is:

$$Np=[Eo[0.9]\hat{}(tp/0.063)]/(hf). \quad \text{(Equation 11)}$$

For a scanning speed, V, and a X-ray beam spot 120 of having an area, Ds, the scanned spots per second, S, is:

$$S=V/Ds. \quad \text{(Equation 12)}$$

Figure 2:
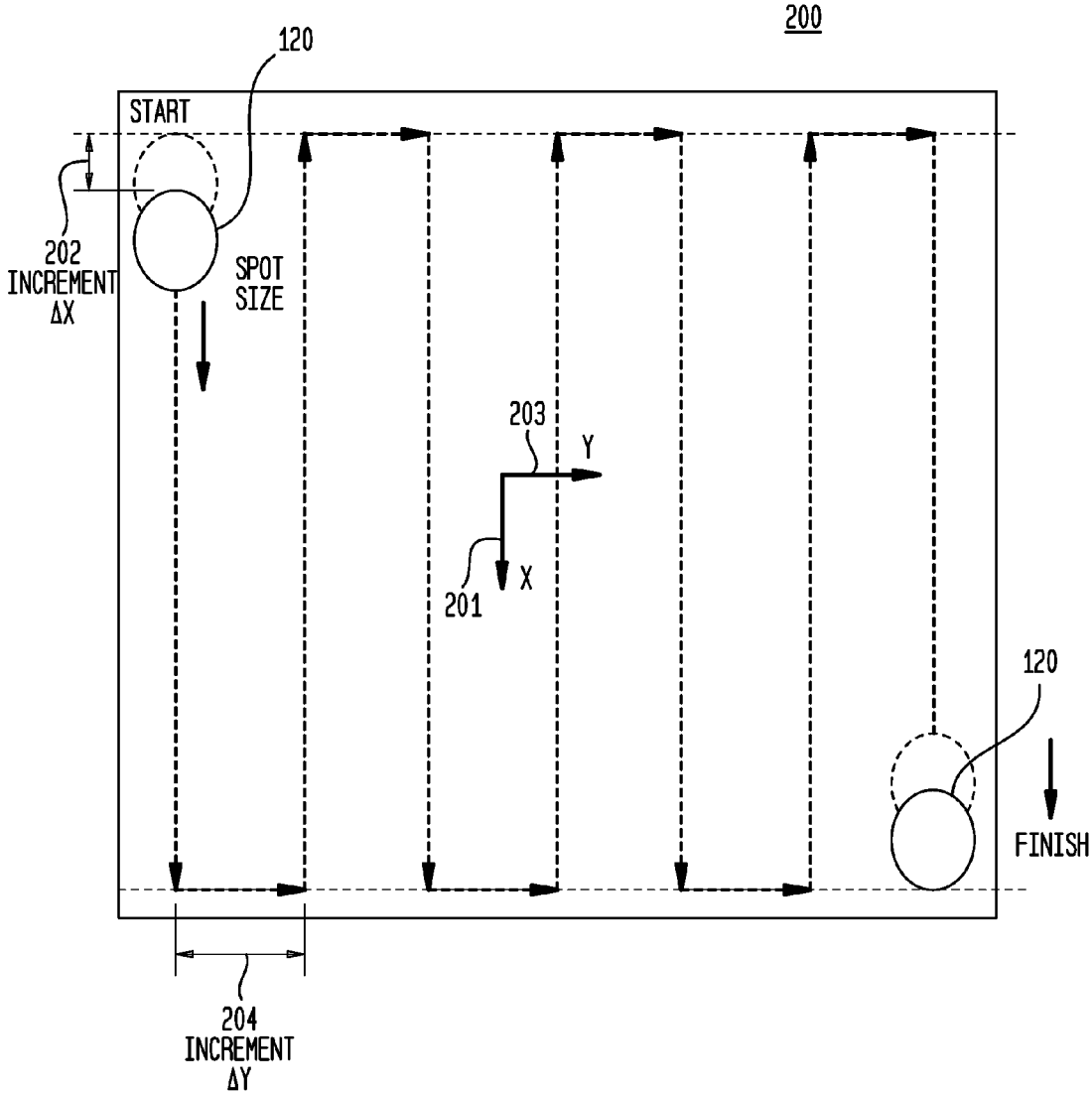
FIG. 2 is a diagram of a raster pattern for scanning in one embodiment of the system and method for dynamically adjusting X-ray power to produce consistent image quality.

Referring now to FIG. 2, a raster scanning pattern 200 is presented. In a raster scanning pattern 200, the position of the spot 120 begins in an initial x-axis 201 and y-axis 203 position. The position of the spot 120 is first moved along one axis 201, 203, for example the x-axis 201, while the position relative to the y-axis 203, is held constant. In an embodiment, the position of the spot 120 is moved by an x-increment 202 in successive time intervals until the spot 120 has traversed the entire length of the subject matter 130 along the x-axis 201, whereupon the spot 120 is repositioned to the start of the x-axis 201 in reversed direction and the position in the y-axis 203 is incremented by a y-increment 204. This action continues until the spot 120 is at the furthest x-axis 201 and y-axis 203 positions of the raster scanning pattern 200, whereupon the spot 120 is returned to initial x-axis 201 and y-axis 203 positions of the raster scanning pattern 200.

In embodiments, the spot 120 is moved in an analog sweep along a first axis, while incremented in a step manner along a second axis. In embodiments, the spot 120 is moved in step fashion along both axis 201, 203. In an embodiment, the area of a spot 120 in some successive time intervals overlaps the area of a spot in a previous time interval. In an embodiment, the area of each spot 120 is non-overlapping with spots 120 from previous time intervals. As would be understood in the art, other scanning patterns could be utilized, for example Lissajous patterns for harmonic scanning, vector-based scanning of particular areas, and polar scanning. Depending on scanning X-ray system, the shape of spot 120 may be rectangular for a fan-beam X-ray system and circular for a pencil-beam system. The size of the spot 120 will depend on configuration of X-ray beam tube 108 and scanning distance 112.

The photon density, ρp, expressed in number per unit area of the spot 120 is:

$$\rho p=Np/[S\pi Ds^2/4]=4Np/[\pi VDs]. \quad \text{(Equation 13)}$$

Using a reference photon density, ρo, obtained from tests for good image quality, the percentage of photon density change in a scan of the scanning X-ray system 100 can be expressed as:

$$\Delta\rho=(\rho o-\rho p)/\rho o\times 100\%. \quad \text{(Equation 14)}$$

Similarly, the power density, Pp, expressed in Joules per unit area of the spot 120 is calculated from:

$$Pp=\{Eo[0.9]\hat{}(tp/0.063)\}/[S\pi Ds^2/4]. \quad \text{(Equation 15)}$$

Using the power density, Po, corresponding to the reference photon density, ρo, the required power adjustment (Joules per second) after penetrating the cover 110 for a scan of the scanning X-ray system 100 is computed as:

$$\Delta E=(Po-Pp)S\pi Ds^2/4. \quad \text{(Equation 16)}$$

This translates into a direct X-ray input power, before the penetration of the cover 110, of:

$$Eo=(Ep+\Delta E)/\{(0.9)\hat{}[tp/(0.063*25.4)]. \quad \text{(Equation 17)}$$

Equation 11 is used to calculate the required power input, in Watts (Joules/sec), for the source of X-rays 102 of the scanning X-ray system 100, to account for the variations in process parameters in order to maintain the consistent image quality. In an embodiment, this power input equation, Equation 17, is built into the scanning X-ray system 100 for in-process control and auto adjustment of the power of the X-ray photons 122 produced by the source of X-rays 102. Note that the material thickness of the cover has been converted from inch into millimeter.

The power input equation, Equation 17, allows the scanning X-ray system 100 to pre-compensate, or adjust, the power of the source of X-rays 102. The power input equation, Equation 17, ensures that the energy incident on the front surface 132 of the target subject matter 130, after the attenuation by the cover 110, is the desired energy to produce an image of acceptable quality.

In order to calibrate the scanning X-ray system 100, reference photon density (the number of X-ray photons 122 per unit area) and corresponding power density (Joules per unit area) for producing acceptable image quality are derived from tests. The reference power density will be used in calculations of X-ray input power adjustment as process parameters vary. For example, if any of the process parameters vary, such as the scan distance 112 to the target subject matter 130, scan speed, changing of the X-ray beam tube 108 or its dimensions, or changing the protective cover 110 between the aperture 106 and the target subject matter 130, then the energy of the X-ray photons 122 produced by the source of X-rays 102 is changed as well. The change to the power of the X-ray photons 122 is based on the test data that produces images of acceptable quality for a given range of process parameters. By using reference photon and power densities that are expressed in terms of per unit area, they can be used in a number of scanning processes for different physical scanning X-ray systems 100.

A first table 300 of FIG. 3 illustrates the effects of increasing scanning speeds 302 on the required input power 304. The scanning speeds 302 increase from 1 cm/sec to 5 cm/sec while other process parameters 306 remain unchanged. Consequently, the photon density 308 decreases dramatically with increasing scanning speed 302. In order to maintain the same image quality, the input X-ray power 304 is substantially increased to compensate for the increase in scanning speed 302. As shown in the subsequent computations, there are no changes in photon density 308 and power density 310 when the input X-ray powers 304 were compensated thus indicating a consistent image quality.

A second table 400 of FIG. 4 illustrates the effects of random variations 402 of process parameters 306 with respect to the reference process parameter 404. The random variations 402 show that the photon density 308 may decrease or increase depends on the process parameters 306. As one scenario 406 shows, the input X-ray power 304 is reduced due to decrease in the standoff distance 408. In all cases, there are no changes in photon density 308 and power density 310 when the input X-ray powers 304 are appropriately adjusted thus indicating a consistent image quality.

The examples in first table 300 and second table 400 demonstrate the feasibility of using this proposed method to obtain the desired image quality.

Figure 5:
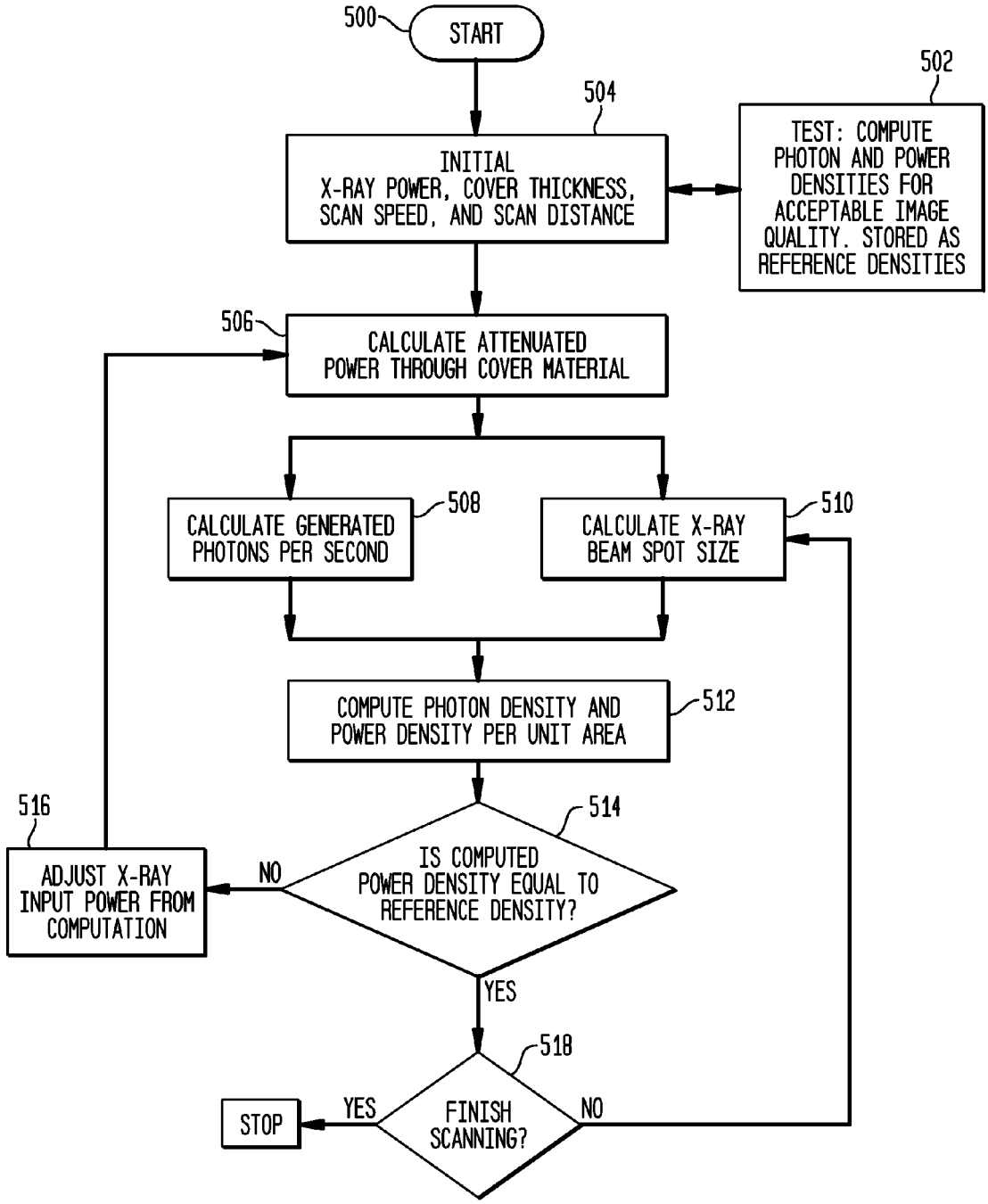
FIG. 5 is a flowchart of a process for dynamically adjust the power of a scan to produce consistent image quality in one embodiment of the system and method for dynamically adjusting X-ray power to produce consistent image quality.

Referring to FIGS. 5 and 6, an exemplary process diagram 500 for a scanning X-ray system 100 is presented. As an initial step, possibly performed by the manufacturer prior to operation, a series of tests using different ranges input X-ray power levels are used to compute and store 502 the photon and power reference densities for acceptable image quality. In an embodiment, they are stored in a database 606 of the scanning X-ray system 100. In embodiments, the database 606 is stored in memory associated with a processor 604, however as would be understood in the art, the database 606 can reside in the scanning X-ray system 100 or in a separate computer or network without affecting the fundamental operation of the system as a whole. Once the reference densities are computed and stored 502, the process parameters are entered into the scanning X-ray system 100, for example into the database 606 or into the processor 604. In embodiments, the process parameters are determined automatically or dynamically during the scanning operation. A processor 604, for example a CPU, DSP, ASIC or other computing means as would be known in the art, either in the scanning X-ray system 100 or separate from the scanning X-ray system 100, uses the reference densities from the database 606 and process parameters of the scanning X-ray system 100 to control one or more process parameters, such as X-ray power. In a non-limiting example, a processor 604 residing in the scanning X-ray system 100 directly controls the X-ray power delivered by the X-ray source 102. In another non-limiting example, a processor 604 residing outside the scanning X-ray system 100 sends a signal to the X-ray source 102 to control the X-ray power.

Continuing to refer to FIG. 5, the scanning X-ray system 100 calculates the attenuated power 506 through the cover 110. The scanning X-ray system 100 calculates the photon rate 508 and calculates the area 510 of the X-ray spot 120. Using these two intermediate calculations, the scanning X-ray system 100 computes photon density and power density per unit area 512 of the spot 120. The scanning X-ray system 100 next compares 514 the calculated photon density and power density per unit area with the reference densities. If the calculated photon density and power density per unit area is not within a threshold range of the reference densities, the scanning X-ray system 100 adjusts 516 the input X-ray power level and proceeds to the operation of calculating the attenuated power 506. If the calculated photon density and power density per unit area are within a threshold range of the reference densities, the scanning X-ray system 100 scans 518 the target subject matter 130 in a scanning pattern 200. As the scanning X-ray system 100 scans 518 the target subject matter 130, the scanning X-ray system 100 performs the operation of calculating the area 510 of the X-ray spot 120 and dynamically adjusts 516 the input X-ray power level as necessary to obtain a consistent image quality across the scanning pattern 200.

Although the exemplary process diagram 500 for the scanning X-ray system 100 of FIG. 5 describes changing only the X-ray power level, the system and method is applicable to operations that change other process parameters without departing from the scope of the disclosure. For example, for scanning X-ray systems 100 with adjustable scan rates for scanning the target subject matter 130, the scan rate can be adjusted in addition to, or separately from, the X-ray power level. For example, if during a scan 518 the processor 604 determines that the resulting image quality will not be acceptable, but the X-ray source 102 is already at its maximum level, the processor 604 can slow the scan rate, or change another adjustable process parameter, until the resulting image quality is at an acceptable level.

In a typical scanning application using a pencil-beam type scanning X-ray system 100, the X-ray beam tube 108 scans by moving in a linear direction perpendicular to the target subject matter 130. The resulting spots 120 are full circles on a flat target subject matter 130. However, in applications where the pencil-beam scanning X-ray system 100 scans in a conical scanning pattern, the X-ray beam tube 108 is fixed at one location and the scanning directions are changing in both azimuth and elevation angles. In this application, the X-ray spots 120 become elongated and might appeared to be elliptical in shapes for portions of the scan of a flat target subject matter 130. For target subject matter 130 that possesses irregular or complex surfaces, the scanning distances 112 will vary continuously and the spots 120 will also assume irregular shapes. When the surface shape of the target subject matter 130 is known or can be anticipated, the area 510 of the X-ray spot 120 will be calculated by approximating the projection of the spot 120 that is normal to the X-ray beam 122. The scanning distance 112 is the minimum distance between the X-ray beam aperture 106 and target subject matter 130.

The embodiments of the invention shown in the drawings and described above are exemplary of numerous embodiments that may be made within the scope of the appended claims. It is contemplated that numerous other configurations of the system and method for dynamically adjusting X-ray power for consistent image quality may be created taking advantage of the disclosed approach. For example, although the system and method is described for X-ray photons 122, and in particular soft X-rays for backscattering, it should be noted that the system and method is applicable to other electromagnetic frequency ranges such at terahertz waves, microwaves, etc. It is the applicant's intention that the scope of the patent issuing herefrom will be limited only by the scope of the appended claims.

What is claimed is:

1. A method for dynamically adjusting an X-ray power level to achieve consistent image quality, comprising:

estimating a power density for a plurality of current process parameters;

estimating an associated photon density for said plurality of current process parameters;

comparing said power density to a reference power density for said current process parameters, said reference power density being associated with a desired image quality;

comparing said photon density to a reference photon density for said current process parameters, said reference photon density being associated with a desired image quality;

adjusting the X-ray power level in response to said comparing operations; and performing said operations of estimating, comparing, and adjusting such that said power density approaches said reference power density, and said photon density approaches said reference photon density.

2. The method of claim 1, wherein a process parameter is selected from the group consisting of the X-ray power level, an X-ray spot area, an aperture, a beam tube length, an attenuation factor of a cover, a scan distance, a scan speed, and a spot rate.

3. The method of claim 1, wherein a process parameter is an X-ray spot area, and further comprising:

performing said operations of estimating, comparing, and adjusting in response to a change in an area of said X-ray spot area.

4. The method of claim 3, wherein said area of said X-ray spot area is estimated based on an expected geometry of said X-ray spot area due to a coordinate position of said X-ray spot area in a scan pattern.

5. The method of claim 4, wherein said area of said X-ray spot area is estimated based on an area that is normal to a direction of a scan beam.

6. The method of claim 1, wherein after said operation of performing said operations of estimating, comparing, and adjusting, said power density is within an acceptable threshold of said reference power density, and said photon density is within an acceptable threshold said reference photon density.

7. The method of claim 1, further comprising:

scanning a first portion of a target subject at the X-ray power level wherein said power density is within an acceptable threshold of said reference power density, and wherein said photon density is within an acceptable threshold of said reference photon density.

8. The method of claim 7, further comprising:

scanning a second portion of a target subject at a different X-ray power level than said first portion of said target subject, and wherein said power density is within an acceptable threshold of said reference power density, and said photon density is within an acceptable threshold of said reference photon density.

9. The method of claim 8, wherein said different power level is a due to a change selected from the group consisting of a change in a scan rate, a change in a scan parameter, a dynamic change in a process parameter, a change in a process parameter resulting from a coordinate position of said X-ray spot area in said scan, a change in an area of said X-ray spot area, a change in a scan distance to said target subject, a movement of said target subject, a change in a geometry of said target subject, a density change associated with a feature of said target subject, a change in a density of a cover.

10. The method of claim 7, wherein said scanning is performed in a pattern selected from the group consisting of a raster scan pattern, a Lissajous scan pattern, a vector-based scan pattern, and a polar scan pattern.

11. The method of claim 10, further comprising:

repeating said operation of computing during the scanning; and, repeating said operation of adjusting said output power of said X-rays during the scanning.

12. The method of claim 10, wherein a process parameter is selected from the group consisting of said X-ray output power, an X-ray spot area incident upon said target, an X-ray spot area incident upon said target that is normal to an X-ray beam, an aperture of said scanner, an attenuation by an intervening cover between said aperture and the target, a beam tube length of said scanner, a scan distance between said aperture and said target, a scan speed of said scanner, and a spot rate.

13. The method of claim 10, wherein the scanning is performed in a pattern selected from the group consisting of a raster scan pattern, a Lissajous scan pattern, a vector-based scan pattern, and a polar scan pattern.

14. The method of claim 10, further comprising:

detecting a returned X-ray energy from the scanning of the target to produce an image of acceptable image quality.

15. The method of claim 14, wherein said returned X-ray energy comprises backscattered X-rays reflected from the target.

16. A method of scanning a target with X-rays with the aid of a computing device, comprising:

providing the computing device with a database for a scanner including at least:

a reference power density for a plurality of process parameters for generating an acceptable image quality;

a reference photon density for a plurality of process parameters for generating an acceptable image quality; and initiating a scan of the target with said scanner with an X-ray having an output power;

computing an attenuation of said output power of said X-rays hitting the target based at least in part on a process parameter; and, adjusting said output power of said X-rays based on said attenuation and said database to produce an acceptable image quality.

17. A scanner adjustment system, comprising:

a database for storing at least:

a reference power density for a plurality of process parameters for generating an acceptable image quality;

a reference photon density for a plurality of process parameters for generating an acceptable image quality; and a processor for:

estimating a power density based at least in part on a current process parameter;

estimating a photon density based at least in part on a current process parameter;

comparing said power density to said reference power density;

comparing said photon density to said reference photon density; and, outputting a signal to adjust a current process parameter based at least in part on said comparing operations.

18. The scanner adjustment system of claim 17, wherein said signal dynamically adjusts an X-ray power level of an X-ray scanner associated with the scanner adjustment system.

19. The scanner adjustment system of claim 17, wherein a process parameter is selected from the group consisting of an X-ray power level, an X-ray spot area, an X-ray spot area normal to a scanning beam, an aperture, a beam tube length, an attenuation factor of a cover, a scan distance, a scan speed, and a spot rate.

20. The scanner adjustment system of claim 17, wherein said processor outputs a signal based in part upon a change in a scan parameter, a dynamic change in a process parameter, a change in a process parameter resulting from a coordinate position of said X-ray spot area in said scan, a change in an area of said X-ray spot area, a change in a scan distance to said target subject, a movement of said target subject, a change in a geometry of said target subject, a density change associated with a feature of said target subject, a change in a density of a cover.

* * * * *